US006210065B1

(12) United States Patent
Tower

(10) Patent No.: US 6,210,065 B1
(45) Date of Patent: Apr. 3, 2001

(54) SEQUENTIAL FIRST PAGE NOTEBOOK

(76) Inventor: Robert P. Tower, 281 Lake Dr., Coconut Creek, FL (US) 33066

( * ) Notice: Subject to any disclaimer, the term of this patent is extended or adjusted under 35 U.S.C. 154(b) by 0 days.

(21) Appl. No.: 09/231,963

(22) Filed: Jan. 15, 1999

(51) Int. Cl.[7] ..... B42F 13/04
(52) U.S. Cl. ..... 402/57; 402/79; 281/21.1
(58) Field of Search ..... 402/57, 76, 79; 281/21.1, 38, 15.1; 40/120, 124

(56) References Cited

U.S. PATENT DOCUMENTS

| | | | | |
|---|---|---|---|---|
| 703,260 | | 6/1902 | Holton . | |
| 808,652 | | 1/1906 | Hackmann et al. . | |
| 1,516,932 | * | 11/1924 | Staab . | |
| 2,091,260 | * | 4/1937 | Farkas et al. . | |
| 2,194,023 | * | 3/1940 | Kranhold . | |
| 2,602,251 | * | 7/1952 | Friedman . | |
| 2,831,285 | * | 4/1958 | Cross . | |
| 3,108,823 | | 10/1963 | Thaw | 281/25 |
| 4,176,473 | * | 12/1979 | Rae . | |
| 4,239,410 | | 12/1980 | Pianta | 402/20 |
| 5,188,562 | * | 2/1993 | Carley . | |
| 5,417,508 | * | 5/1995 | Friedman . | |
| 5,503,486 | | 4/1996 | Zane | 402/72 |
| 5,597,256 | * | 1/1997 | Burton et al. . | |
| 5,791,802 | * | 8/1998 | Englum . | |
| 5,795,090 | * | 8/1998 | Jackson . | |
| 5,816,730 | * | 10/1998 | Alspaw et al. . | |

* cited by examiner

*Primary Examiner*—A. L. Wellington
(74) *Attorney, Agent, or Firm*—Oltman, Flynn & Kubler

(57) ABSTRACT

A notebook includes several pages each having a page binder edge and a page free edge, and having at least two page binder holes adjacent to the page binder edge, the pages being stacked sequentially face to face to form a pad so that corresponding page binder holes register with each other; a wire binder passing through registering the page binder holes; and a cover including a cover sheet portion with a cover free edge and with a cover binder edge having a binder engaging slat portion spaced apart and substantially parallel with the cover binder edge defining a page passing slot through which the wire binder passes; so that the page free edge of each forward most page can be arched over the remainder of the forward most page, fitted into and rotated about the wire binder entirely through the page passing slot and placed against the back of the pad.

8 Claims, 5 Drawing Sheets

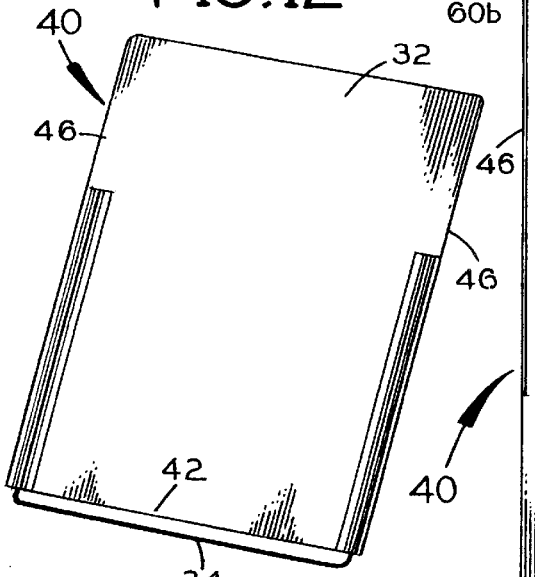
FIG.12
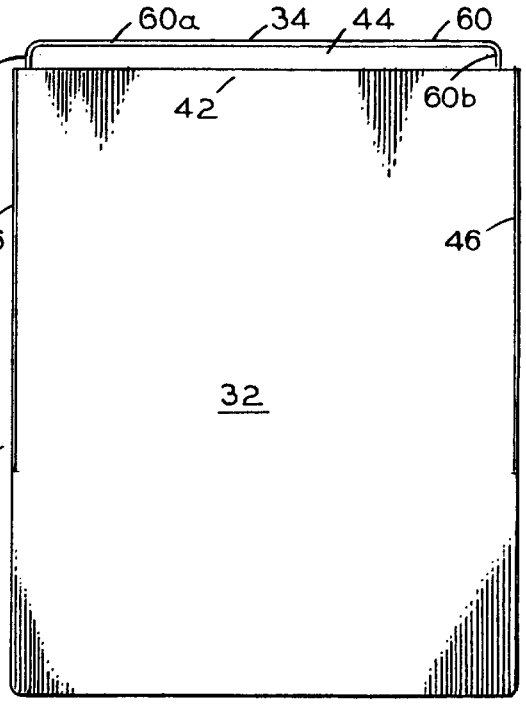
FIG.15
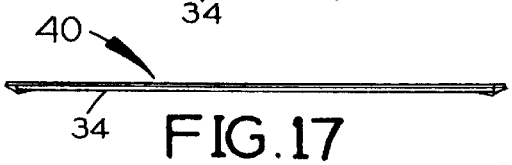
FIG.17
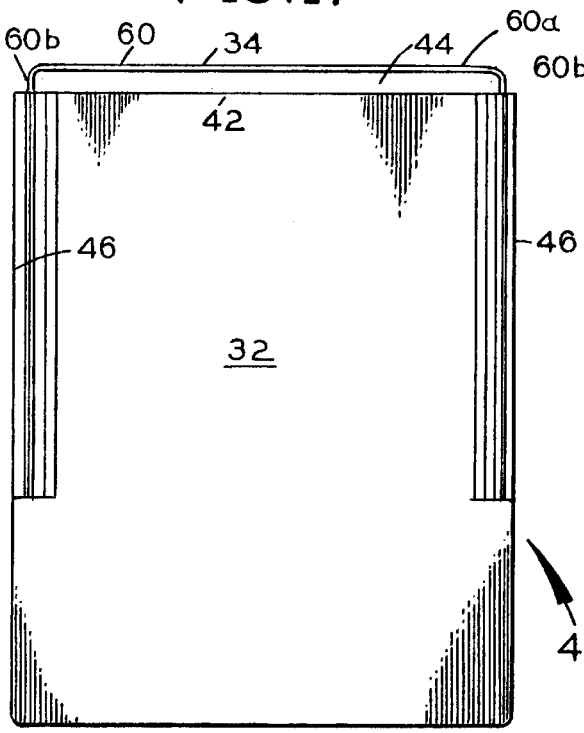
FIG.13
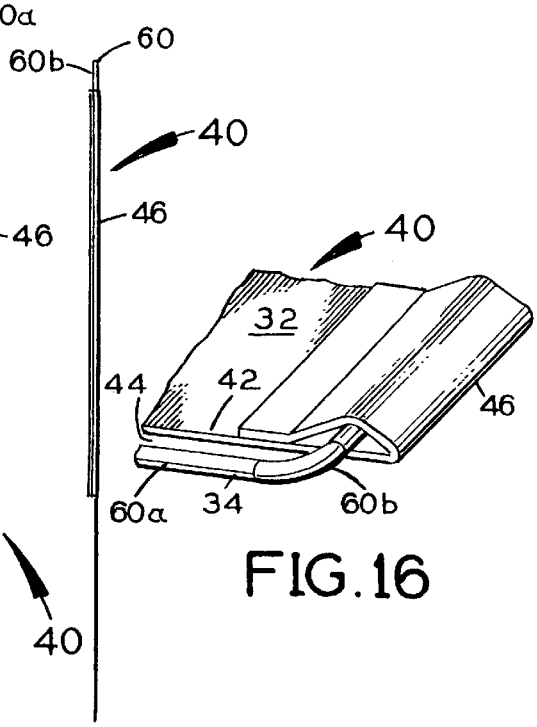
FIG.16
FIG.14

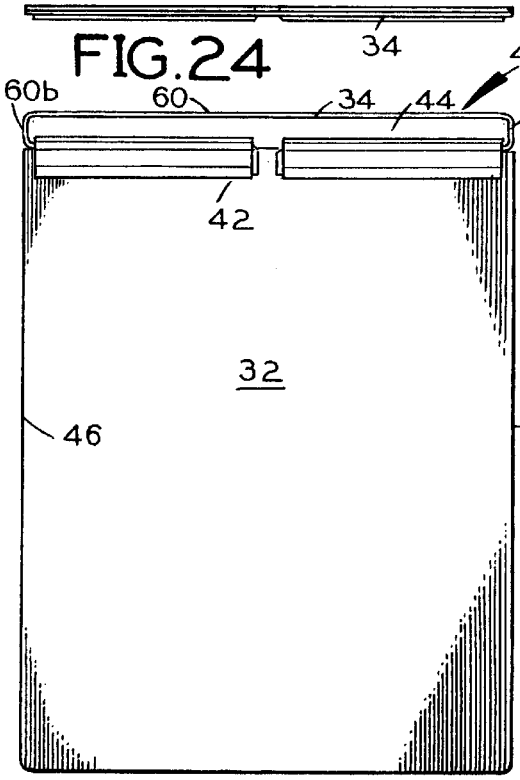
FIG.24
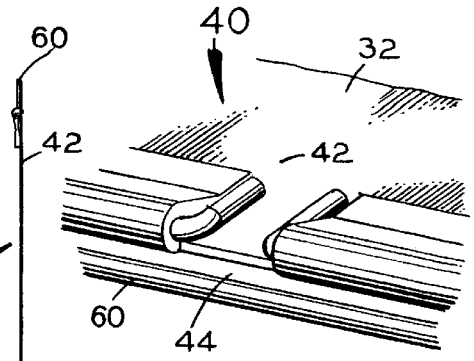
FIG.23
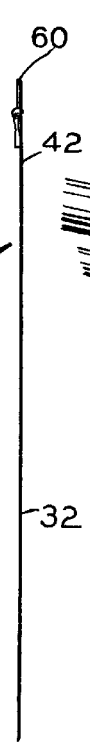
FIG.20
FIG.19
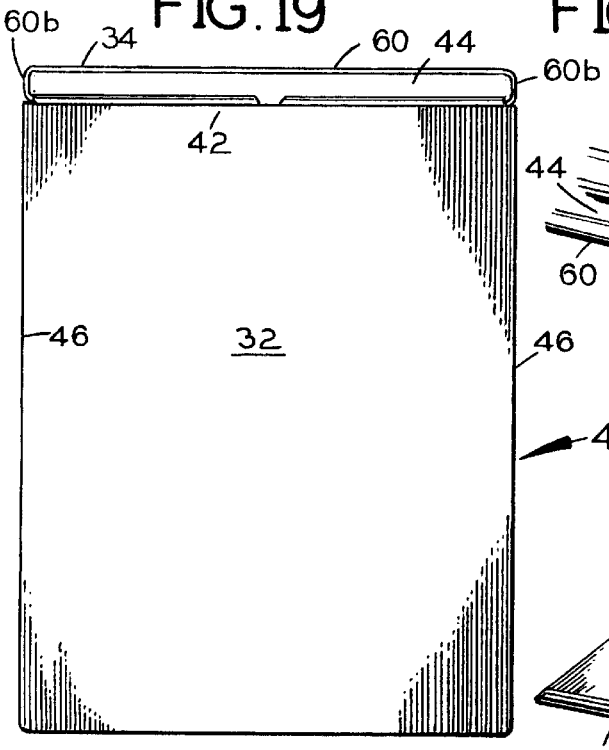
FIG.21
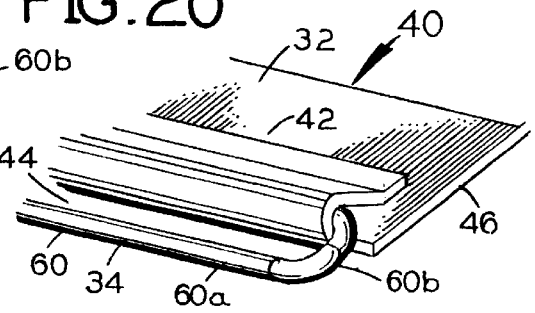
FIG.22
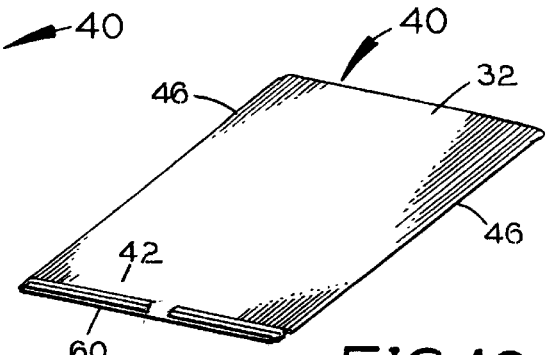
FIG.18

SEQUENTIAL FIRST PAGE NOTEBOOK

FILING HISTORY

This application is based upon the contents of Disclosure Document No. 441,588, recorded on Aug. 6, 1998.

BACKGROUND OF THE INVENTION

1. Field of the Invention

The present invention relates generally to the field of stationery, books, office and school products generally. More specifically the present invention relates to a notebook having a plurality of pages forming a pad and bound together at a page binder edge by a ring or spiral binder, and having a cover constructed to permit the sequential passage of the forward-most, or first page through a slot in or beside the cover to become the last page in the pad. The rotated page becomes the last page in the pad, rather than merely a folded back first page, because no part of the cover or binder extends between the rotated first page and the remainder of the pad. First page rotation exposes and causes the second page to become the first page, which may then be rotated to the back of the pad to expose and cause the next page to become the first page. This page rotation may be performed indefinitely.

2. Description of the Prior Art

There have long been notebooks including note pads for containing a series of bound pages and arranged so that each page can be folded behind the pad after use. A problem with these prior pads has been that the cover must be folded behind the pad, and then pages folded behind the cover, so that pages rotated behind the pad are obstructed by the cover or other notebook parts from rejoining the pad. Then, to close the notebook so that the cover is exposed outside the pad, the used pages must be folded back on top of unused pages. As a result, when the user wishes to begin writing on the next available page, he or she must flip past all the used pages to reach it.

Holton, U.S. Pat. No. 703,260, issued on Jun. 24, 1902, discloses a tablet including a stack of writing sheets and a one piece binder in the form of two spaced apart binder rings interconnected by a connecting rod. The rings have flat back portions to rest on a table and curved front portions around which the sheets are rotated after use. The sheets cannot rotate all the way around the rings to reach the back of the stack, however, because the ring connecting rod would stop them.

Hackmann, et al., U.S. Pat. No. 808,652, issued on Jan. 2, 1906, teaches a note book having a binder similar to that of Holton. Two circular binder rings are interconnected by a straight rod portion, which would prevent full sheet rotation just as in Holton.

Thaw, U.S. Pat. No. 3,108,823, issued on Oct. 29, 1963 for a paper securement device, includes binder rings mounted onto a backboard which can be opened to load and reload paper. Pianta, U.S. Pat. No. 4,239,410, issued on Dec. 16, 1980 reveals a stationary booklet having cardboard covers and a refillable binder made up of tubular rings passing through slots in the cover and sheets, which can be split longitudinally and reconnected. Zane, U.S. Pat. No. 5,503,486, issued on Apr. 2, 1996, discloses a notebook and notebook cover assembly. None of these devices appear to permit the full rotation of sheets from the front to the back of a pad.

It is thus an object of the present invention to provide a notebook including a pad of writing pages having a pad cover which permits sequential rotation of the forward most page past the cover to the back of the pad, to become the last page in the pad, so that the next page to be used is always the first page in the notebook.

It is another object of the present invention to provide such a notebook which permits such forward most page rotation without removal of the pad cover.

It is still another object of the present invention to provide a conventional notebook with a cover conversion kit including means for existing cover removal and at least one replacement cover having the characteristics of the present invention covers to permit forward most page rotation, past the cover to the back of the pad.

It is finally an object of the present invention to provide such a notebook which is simple in design and inexpensive to manufacture.

SUMMARY OF THE INVENTION

The present invention accomplishes the above-stated objectives, as well as others, as may be determined by a fair reading and interpretation of the entire specification.

A notebook is provided including several pages each having a page binder edge and a page free edge, and having at least two page binder holes adjacent to the page binder edge, the pages being stacked sequentially face to face to form a pad so that corresponding page binder holes register with each other; a binder passing through registering the page binder holes; and a cover including a cover sheet portion with a cover free edge and with a cover binder edge having a binder engaging slat portion spaced apart and substantially parallel with the cover binder edge defining a page passing slot through which the binder passes; so that the page free edge of each forward most page can be arched over the remainder of the forward most page, fitted into and rotated about the binder entirely through the page passing slot and placed against the back of the pad.

The binder is optionally a spiral wire threaded through the registering page holes to hold the pages and the cover together while permitting page rotation. The binder alternatively includes a series of ring-shaped wires each fitted through one registering series of the page holes to hold the pages together and permit page rotation. The slat portion is optionally part of the cover sheet portion and the page passing slot is optionally cut into the cover sheet portion to define the slot portion and is adjacent and parallel to the cover binder edge through which the binder passes.

The cover alternatively includes a plate having a plate binder edge and a plate anchor edge, the plate anchor edge having punched out tabs which penetrate the cover sheet portion and are bent to hold the plate to the cover sheet portion, and the plate binder edge in this instance overhangs the cover binder edge and includes the page passing slot. The slat alternatively includes a cover mounting rod having a binder engaging segment extending parallel to and spaced apart from the cover binder edge to define the page passing slot, the cover mounting rod including at each end a rod anchor segment angled from the binder engaging segment and secured to the sheet.

BRIEF DESCRIPTION OF THE DRAWINGS

Various other objects, advantages, and features of the invention will become apparent to those skilled in the art from the following discussion taken in conjunction with the following drawings, in which:

FIG. 12 is a perspective view of another alternative embodiment of a notebook cover having the cover mounting rod secured to the cover with turned over and fastened cover sheet portion side edges defining the page passing slot.

FIG. 13 is a front view of the cover of FIG. 12.

FIG. 14 is a side edge view of the cover of FIG. 12.

FIG. 15 is a rear view of the cover of FIG. 12.

FIG. 16 is detail of an upper corner of the cover of FIG. 12.

FIG. 17 is a top edge view of the cover of FIG. 12.

FIG. 18 is a perspective view of another alternative embodiment of a notebook cover having the cover mounting rod secured to the cover with a turned over and fastened cover sheet portion binder edge defining the page passing slot.

FIG. 19 is a front view of the cover of FIG. 18.

FIG. 20 is a side edge view of the cover of FIG. 18.

FIG. 21 is a rear view of the cover of FIG. 18.

FIG. 22 is detail of an upper corner of the cover of FIG. 21.

FIG. 23 is detail of a middle section of the cover of FIG. 21. The rod anchor segments are bent to parallel the cover binder edge and bent again to extend toward the cover free end, to prevent rod anchor segment rotation relative to the given cover.

FIG. 24 is a top edge view of the cover of FIG. 18.

DETAILED DESCRIPTION OF THE PREFERRED EMBODIMENTS

Figure 1:
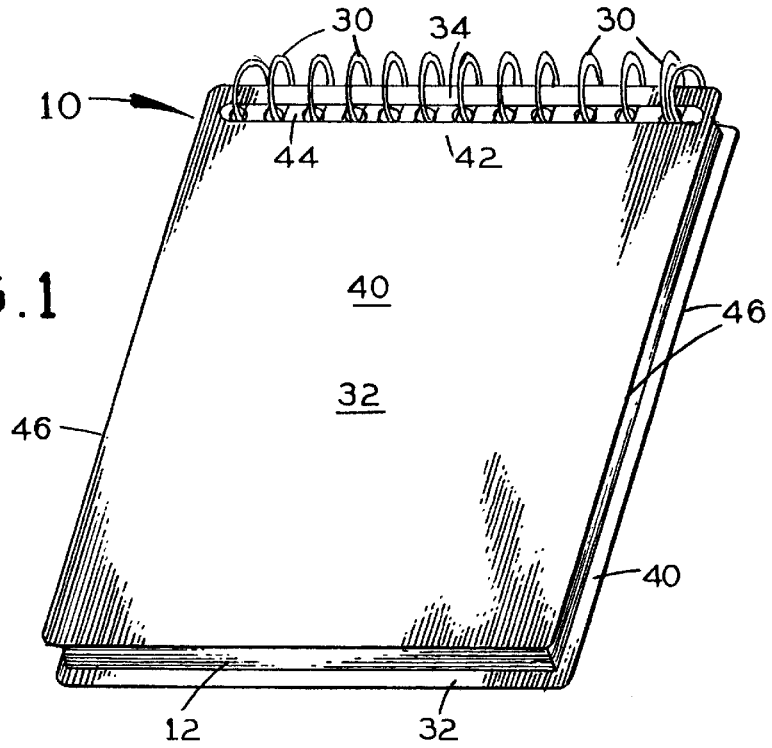
FIG. 1 is a perspective view of the notebook of the first preferred embodiment showing front and back covers and a spiral binder passing through the page passing slot in the cover sheet portions and through the page holes.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
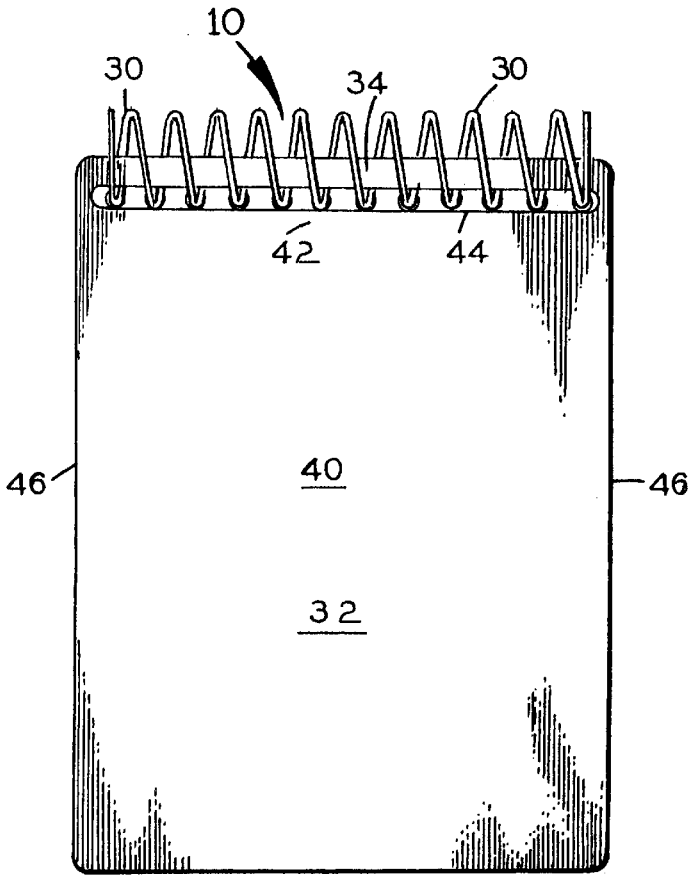
FIG. 2 is a front view of the notebook of FIG. 1.
Figure 3:
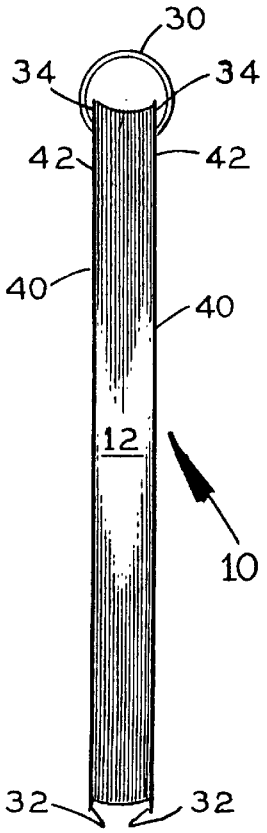
FIG. 3 is a side view of the notebook of FIG. 1.
Figures 4, 5:
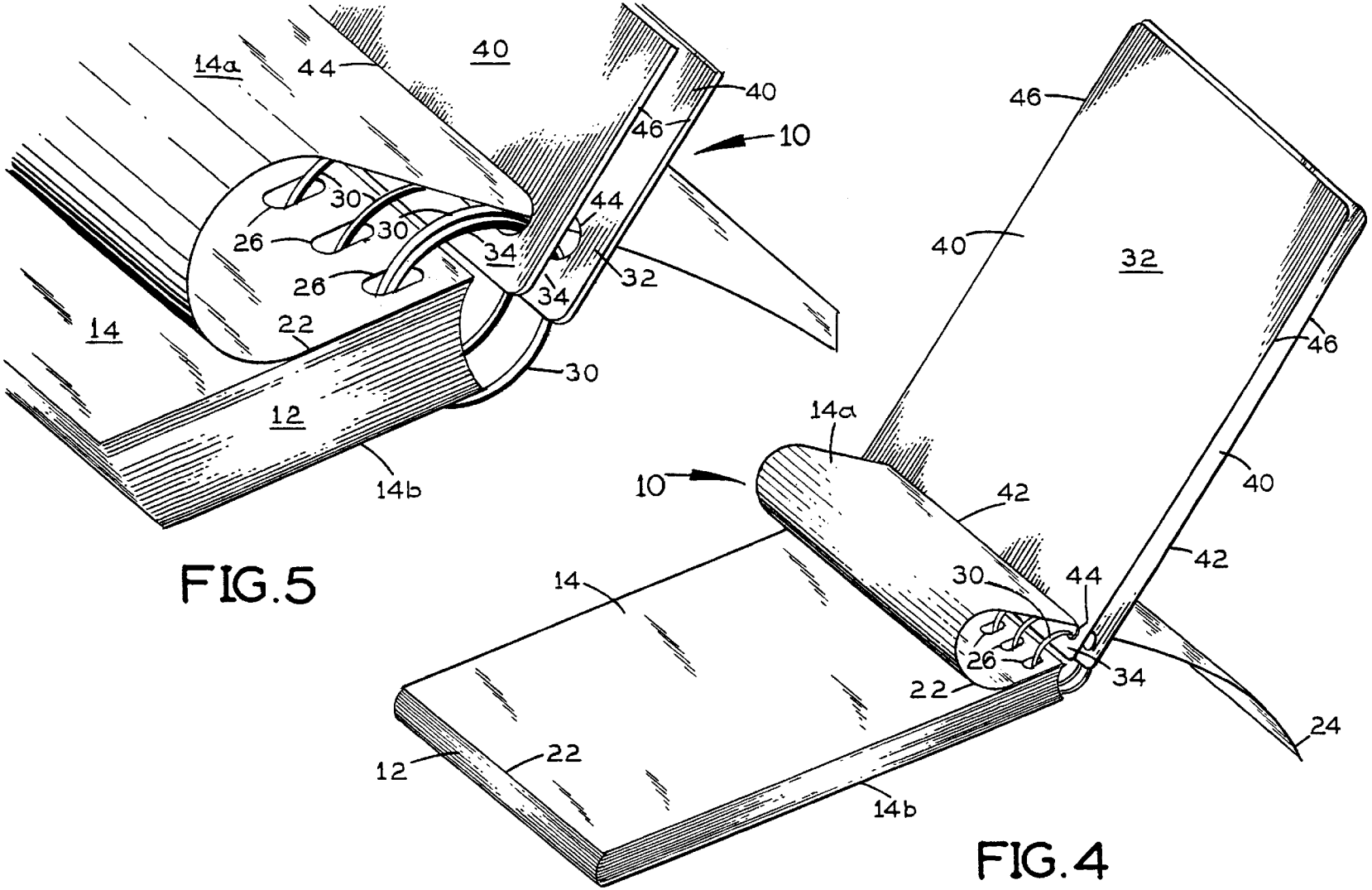
FIG. 4 is a perspective view of the notebook showing the forward most page being inserted into and passing through the page passing slot to become the rear most page. The wire ring binder alternative is illustrated.
FIG. 5 is a close-up of the detail marked in FIG. 4.
Figure 6:
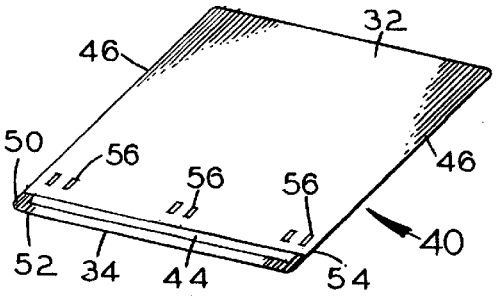
FIG. 6 is a perspective view of an alternative embodiment of a notebook cover having the plate secured to the cover with tabs and the page passing slot in the plate.
Figure 9:
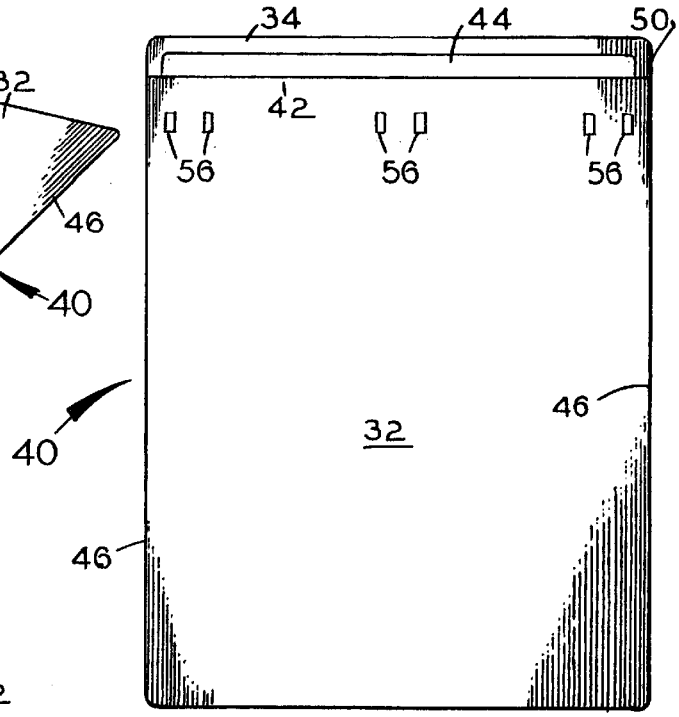
FIG. 9 is a rear view of the cover of FIG. 6.
Figure 11:
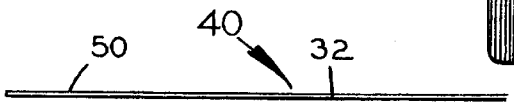
FIG. 11 is a top edge view of the cover of FIG. 6.
Figure 7:
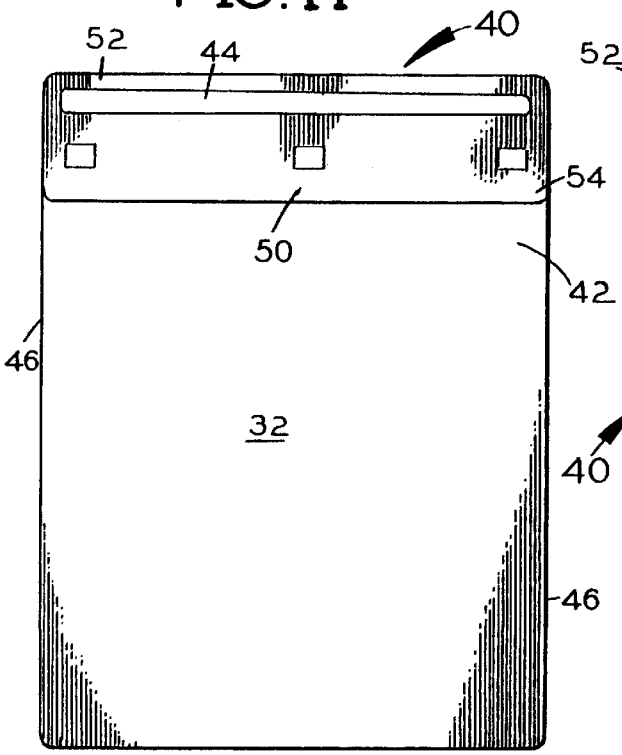
FIG. 7 is a front view of the cover of FIG. 6.
Figure 10:
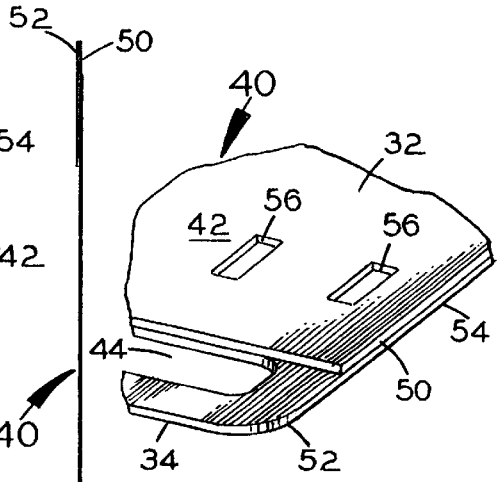
FIG. 10 is detail of an upper corner of the cover of FIG. 9.
Figure 8:
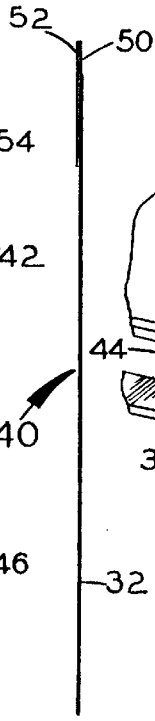
FIG. 8 is a side edge view of the cover of FIG. 6.

Referring to FIGS. 1–24, a notebook 10 is disclosed having a pad 12 of pages 14 bound together at one edge by a binder 30 such as a tubular, ring or spiral wire binder, and having a cover 40 constructed to permit the sequential passage of the forward most, or first, page 14*a* through or beside the cover to become the last page 14 in the pad 12. The rotated page 14 becomes the last page in pad 12, rather than merely a folded back first page 14*a*, because no part of cover 40 or binder 30 extends between the rotated page 14 and the other pages making up pad 12. First page 14*a* rotation exposes and causes the second page 14 of pad 12 to become the first page, which subsequently may be rotated to the back of pad 12 in the same way to expose and cause the next page 14 to become the first page 14*a*. This page rotation may be performed sequentially until the original last page 14*b* of pad 12 becomes the first page. The rotated pages 14 all may be rotated in sequence indefinitely to each become the first page 14*a* once again. The wire may be formed of metal, plastic or any other suitable material.

The pages 14 making up pad 12 preferably each have page binder edges 22 and page free edges 24, and a series of binder holes 26 punched along page binder edges 22, so that corresponding holes 26 of the several pages 14 register with each other. The preferred spiral and ring binders 30 are of conventional design and are illustrated in FIGS. 1–3 and FIGS. 4–5, respectively. The binder wire, whether forming a series of rings or a single spiral, extends through registering binder holes 26 along page binder edges 22 to hold the pages 14 together and permit page rotation. Cover 40 includes a cover sheet portion 32 which is preferably is a cardboard or plastic sheet.

For one embodiment, cover sheet portion 32 has a cover binder edge 42 and a page passing slot 44 adjacent and parallel to cover binder edge 42 through which spiral wire binder 30 passes. The portion of cover 40 between the slot 44 and cover binder edge 42 defines a binder coupling slat 34. The page free edge 24 of each forward most page 14*a* is in turn curled by hand and arched over the remainder of the page 14*a* generally toward its page binder edge 22, fitted into and pulled entirely through page passing slot 44 until the rotated page rests against the back of pad 12.

A variation of the first embodiment of notebook 10 is provided in which the page passing slot 44 is located in an elongate plate 50 formed of metal, plastic or other suitable material, and having a longitudinal plate binder edge 52 and a longitudinal plate anchor edge 54. See FIGS. 6–11. In this instance, the portion of plate 50 between slot 44 and plate binder edge 52 defines slat 34. Plate anchor edge 54 has punched out tabs 56 which penetrate cover sheet portion 32 and are bent over on the opposing face of sheet portion 32 to join plate 50 and sheet portion 32 together. Plate binder edge 52 overhangs the cover binder edge 42 and includes longitudinal page passing slot 44 which receives the wire binder 30 and passes pages 14 in the same way that the above described page passing slot 44 does.

A second embodiment is provided in which the cover 40 includes a cover mounting rod 60 having a binder engaging segment 60*a* extending parallel to and spaced apart from cover binder edge 42 and passing longitudinally through the wire binder 30. See FIGS. 12–17. Binder engaging segment 60 functions as slat 34 and the space between binder engaging segment 60 and cover binder edge 42 define slot 44. Cover mounting rod 60 includes rod anchor segments 60*b* which are continuous with and turned at right angles from binder engaging segment 60*a* toward and onto the face of cover sheet portion 32 and parallel to opposing cover side edges 46. Cover side edges 46 are each preferably folded over part of the remainder of cover 40, over the adjacent rod anchor segment 60*b* and glued face to face with the remainder of cover 40 to hold rod anchor segments 60*b* in place. The page free edge 24 of each forward most page 14*a* is subsequently turned back by hand and arched over the remainder of the page 14*a* toward the page binder edge 22, fitted into and pulled entirely through the gap between wire binder 30 and cover binder edge 42 until the rotated page rests against the back of pad 12. Rod anchor segments 60*b* are alternatively engaged along cover binder edge 52, as shown in FIGS. 18–24.

For any of the above embodiments, one cover 40 may be provided for the front or the back of the pad 12, or two such covers 40 to function as front and rear covers may be provided. In the latter instance, both covers pass pages 14 from front to back of the pad 12 through their respective slots 44 as described above for one cover 40. An optional feature of notebook 10, which is not shown in the FIGURES, is cover connecting material such as paper or other suitable material interconnecting the cover binder edges of front and rear covers 40. The cover connecting material is designed so that it folds up between the front and rear covers 40 when their cover binder edges 42 are advanced toward each other so that it does not obstruct the gap between cover binder edges 42 and binder 30. This cover connecting material helps reduce excess travel of front and rear covers 40 relative to each other and to pad 12, and provides additional protection to pages 14.

Apparatus 10 is alternatively provided in kit form. Such a kit includes instructions to the purchaser to cut off original covers on an off-the-shelf wire binder notebook and to install the above-described covers 40 by inserting the slat 34 into the wire binder 30, either by inserting it through breaks in wire rings or by feeding the slat 34 through a spiral wire and through the page holes 26 by rotating the spiral wire.

There may be paper or other material connecting the tops of the front and back cover. The material will be designed such that it will fold up in between the two covers when they are put together so that it won't block the gap between the covers and the binding that the paper sheets go in between. This material will help to reduce excess cover travel and extend the protection that the covers provide to the sheets.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A notebook, comprising:

a plurality of pages each having a page binder edge and an opposing page free edge, and having a plurality of page binder holes adjacent to said page binder edge, said pages being stacked sequentially face to face to form a pad such that corresponding said page binder holes register with each other;

a cover including a cover sheet portion with a cover free edge and an opposing cover binder edge and a page passing slot adjacent and substantially parallel to said cover binder edge;

and a binder comprising a strandular member arched into a substantially circular configuration and passing through said page binder holes and arching around said page binder edges, and passing through said page passing slot in said cover and arching around said cover binder edge, such that at least a segment of each said page binder edge passes within said binder and said segment of said page binder edge constitutes an outermost extremity of each said page, and such that at least a segment of said cover binder edge passes within said binder and said segment of said cover binder edge constitutes an outermost extremity of said cover;

such that the page free edge of each forward-most page can be arched over the remainder of said forward most page, fitted into and rotated about said binder entirely through said page passing slot and placed against the back of a page in said pad.

2. A notebook according to claim 1, wherein said binder is a spiral wire threaded through said registering page holes.

3. A notebook according to claim 1, wherein said binder comprises a series of ring-shaped wires each fitted through one registering series of said page holes.

4. A notebook according to claim 1, wherein said cover binder edge is part of a slat connected in spaced relation to said cover sheet portion and said page passing slot is cut into said cover sheet portion to define said slot portion and is adjacent and parallel to said cover binder edge through which said binder passes.

5. A notebook according to claim 4, wherein said cover comprises a plate having a plate binder edge and a plate anchor edge, said plate anchor edge having punched out tabs which penetrate said cover sheet portion and are bent to hold said plate to said cover sheet portion, and wherein said plate binder edge overhangs said cover binder edge and comprises said page passing slot.

6. A notebook according to claim 4, wherein said slat comprises a cover mounting rod having a binder engaging segment extending parallel to and spaced apart from said cover binder edge to define said page passing slot, said cover mounting rod comprising at each end a rod anchor segment angled from said binder engaging segment and secured to said sheet.

7. A notebook, comprising:

a plurality of pages each having a page binder edge and an opposing page free edge, and having at least one page binder hole adjacent to said page binder edge, said pages being stacked sequentially face to face to form a pad such that corresponding said page binder holes register with each other;

a cover including a cover sheet portion with a cover free edge and an opposing cover binder edge and a page passing slot adjacent and substantially parallel to said cover binder edge;

and a binder comprising a strandular member arched into a substantially circular configuration and passing through said page binder holes and arching around said page binder edges, and passing through said page passing slot in said cover and arching around said cover binder edge, such that at least a segment of each said page binder edge passes within said binder and said segment of said page binder edge constitutes an outermost extremity of each said page, and such that at least a segment of said cover binder edge passes within said binder and said segment of said cover binder edge constitutes an outermost extremity of said cover;

such that the page free edge of each forward-most page can be arched over the remainder of said forward most page, fitted into and rotated about said binder entirely through said page passing slot and placed against the back of a page in said pad.

8. A notebook, comprising:

a plurality of pages each having a page binder edge and an opposing page free edge, and having a plurality of page binder holes adjacent to said page binder edge, said pages being stacked sequentially face to face to form a pad such that corresponding said page binder holes register with each other;

a front cover including a front cover sheet portion with a front cover free edge and an opposing front cover binder edge and a front cover page passing slot adjacent and substantially parallel to said front cover binder edge;

a rear cover including a rear cover sheet portion with a rear cover free edge and an opposing rear cover binder edge and a rear cover page passing slot adjacent and substantially parallel to said rear cover binder edge;

and a binder comprising a strandular member arched into a substantially circular configuration and passing through said page binder holes and arching around said page binder edges, and passing through said front cover page passing slot and said rear cover page passing slot and arching around said front and rear cover binder edges, such that at least a segment of each said page binder edge passes within said binder and said segment of said page binder edge constitutes an outermost extremity of each said page, and such that at least a segment of said front cover binder edge passes within said binder and said segment of said front cover binder edge constitutes an outermost extremity of said front cover, and such that at least a segment of said rear cover binder edge passes within said binder and said segment of said rear cover binder edge constitutes an outermost extremity of said rear cover;

such that the page free edge of each forward-most page can be arched over the remainder of said forward most page, fitted into and rotated about said binder entirely through said front cover page passing slot and said rear cover page passing slot and placed against the back of a page in said pad.

* * * * *